US011708843B2

(12) United States Patent
Nickel et al.

(10) Patent No.: US 11,708,843 B2
(45) Date of Patent: Jul. 25, 2023

(54) ELECTRIC COOLANT PUMP HAVING A COOLANT FLOW PATH AROUND A STATOR, A ROTOR AND A CONTROL CIRCUIT

(71) Applicant: NIDEC GPM GmbH, Auengrund OT Merbelsrod (DE)

(72) Inventors: Conrad Nickel, Troistedt (DE); Franz Pawellek, Lautertal (DE); Jens Hoffmann, Schwarzbach (DE)

(73) Assignee: NIDEC GPM GMBH, Auengrund OT Merbelsrod (DE)

( * ) Notice: Subject to any disclaimer, the term of this patent is extended or adjusted under 35 U.S.C. 154(b) by 43 days.

(21) Appl. No.: 16/976,663

(22) PCT Filed: Dec. 13, 2018

(86) PCT No.: PCT/EP2018/084743

§ 371 (c)(1),
(2) Date: Aug. 28, 2020

(87) PCT Pub. No.: WO2019/166118

PCT Pub. Date: Sep. 6, 2019

(65) Prior Publication Data

US 2021/0003147 A1 Jan. 7, 2021

(30) Foreign Application Priority Data

Mar. 2, 2018 (DE) ..... 102018104770.3

(51) Int. Cl.
*F04D 29/58* (2006.01)
*F04D 13/06* (2006.01)
(Continued)

(52) U.S. Cl.
CPC ..... *F04D 29/5806* (2013.01); *F04D 13/06* (2013.01); *F04D 29/586* (2013.01);
(Continued)

(58) Field of Classification Search
CPC ..... F05B 2260/232; F04D 13/0653; F04D 29/70; F04D 7/00; F01P 2003/001; F01P 2003/003
See application file for complete search history.

(56) References Cited

U.S. PATENT DOCUMENTS 4,198,191 A * 4/1980 Pierce ..... F04D 29/588 310/54
5,053,664 A * 10/1991 Kikuta ..... H02K 29/08 310/114
(Continued)

FOREIGN PATENT DOCUMENTS

DE 69818392 T2 7/2004
DE 102007055907 A1 6/2009
(Continued)

OTHER PUBLICATIONS

International Search Report for PCT/EP2018/084743, dated Mar. 28, 2019.
(Continued)

*Primary Examiner* — Nathan C Zollinger
*Assistant Examiner* — Timothy P Solak
(74) *Attorney, Agent, or Firm* — Merchant & Gould P.C.

(57) ABSTRACT

An electric coolant pump (1) conveys cooling fluid in order to cool a combustion engine of a vehicle. The electric coolant pump (1) has a pump impeller (2) for accelerating the coolant to be conveyed, a rotor shaft (3) on which the pump impeller (2) is fixed, an electric motor (6), having a stator (8) and a rotor (7), for driving the rotor shaft (3). A control circuit (13) controls the electric motor (6). A pump housing (10) accommodates at least the control circuit (13) and the electric motor (6). The coolant to be conveyed is able
(Continued)

to flow through the pump housing (10). The coolant to be conveyed thereby flows around the stator (8), the rotor (6) and the control circuit (13).

5 Claims, 3 Drawing Sheets

(51) Int. Cl.
*F04D 29/70* (2006.01)
*F04D 7/00* (2006.01)
*F04D 29/046* (2006.01)

(52) U.S. Cl.
CPC ..... *F04D 29/5813* (2013.01); *F04D 7/00* (2013.01); *F04D 13/0653* (2013.01); *F04D 29/046* (2013.01); *F04D 29/588* (2013.01); *F04D 29/708* (2013.01); *F05B 2260/232* (2013.01)

(56) References Cited

U.S. PATENT DOCUMENTS 5,939,813 A 8/1999 Schob
5,949,171 A 9/1999 Horski et al.
5,997,261 A * 12/1999 Kershaw ..... H02K 9/19 417/366
6,011,331 A * 1/2000 Gierer ..... H02K 29/06 310/52
6,447,270 B1 * 9/2002 Schmidt ..... H02K 11/33 165/80.4
6,676,505 B2 * 1/2004 Behl ..... G11B 33/148
7,227,286 B2 * 6/2007 Kudo ..... H02K 7/14 310/58
8,080,909 B2 * 12/2011 Perkins ..... H02K 9/19 310/59
2006/0174642 A1 * 8/2006 Nagashima ..... H02K 9/19 62/119
2007/0140844 A1 * 6/2007 Yoshida ..... F04D 29/582 415/220
2013/0302142 A1 11/2013 Chiu et al.
2015/0252808 A1 * 9/2015 Rosinski ..... F04D 13/06 417/423.5
2015/0349594 A1 * 12/2015 Zhang ..... F04D 13/06 417/423.7

FOREIGN PATENT DOCUMENTS

DE 102009009898 A1 8/2010
DE 102013211181 B3 8/2014
DE 102015214788 A1 2/2017
EP 0967707 A2 12/1999
EP 1775478 A2 4/2007

OTHER PUBLICATIONS

Office Action for German Patent Application No. 102018104770.3, dated Nov. 30, 2018.
Office Action for Chinese Patent Application No. 201880090629.6, dated Apr. 2, 2021.

* cited by examiner

ELECTRIC COOLANT PUMP HAVING A COOLANT FLOW PATH AROUND A STATOR, A ROTOR AND A CONTROL CIRCUIT

This application is a National Stage Application of PCT/EP2018/084743, filed Dec. 13, 2018, which claims the benefit of German Patent Application No. 102018104770.3, filed Mar. 2, 2018, and which applications are incorporated herein by reference. To the extent appropriate, a claim of priority is made to each of the above-disclosed applications.

The invention relates to an electric coolant pump, in particular for conveying cooling fluid in order to cool a combustion engine of a vehicle.

BACKGROUND OF THE INVENTION

An electric coolant pump such as this, having a pump impeller fixed on a rotor shaft and having an electric motor driving the rotor shaft is known from DE 698 18 392 T2. The pump housing in which the electric motor is accommodated has the coolant to be conveyed flowing through it. The waste heat generated in the rotor and stator during operation of the electric motor can in this way be transferred to the coolant and the coolant pump can be cooled accordingly. In turn, this leads to an increase in the efficiency of the electric motor. However, the control circuit of the electric motor is disposed in a separate receiving chamber separated from the actual pump housing. The electronic components of the control circuit are therefore not in direct contact with the coolant. The cooling effect of the coolant on the control circuit is therefore low at best.

It is therefore the object of the present invention to provide an electric coolant pump with a high level of heat discharge.

This object is achieved in accordance with the invention by an electric coolant pump having the features of claim 1.

SUMMARY OF THE INVENTION

The electric coolant pump has a pump impeller for accelerating the coolant to be conveyed, a rotor shaft on which the pump impeller is fixed, an electric motor, having a stator and a rotor, for driving the rotor shaft, a control circuit for controlling the electric motor, and a pump housing which accommodates at least the control circuit and the electric motor. The pump housing can have the coolant to be conveyed flowing through it. The coolant to be conveyed thereby flows around the stator, the rotor and the control circuit.

During operation of the coolant pump, the pump housing has the coolant to be conveyed flowing through it. In other words, in addition to conveying the coolant in the actual cooling circuit (e.g. cooling circuit for cooling a combustion engine of a motor vehicle) the pump impeller generates a volume flow of the coolant through the pump housing. The components disposed within the pump housing, in particular the stator, the rotor and the control circuit, therefore have coolant flowing around them. The waste heat generated by said components can in this way be efficiently discharged.

At this point it should be emphasized that not only the stator and the rotor of the electric motor but also the control circuit have coolant flowing around them. This means that the electronic components (e.g. electronic circuit elements, circuit boards, . . . ) of the control circuit are in direct contact with the coolant to be conveyed. This direct contact leads to particularly effective cooling of the control circuit. In comparison to conventional electric coolant pumps, in which such contact between the coolant and the control circuit is absent, in this way the power density can be increased, the construction size can be reduced, reliability can be improved and/or the service life extended.

The control circuit can be designed as an electronic control unit (ECU).

Advantageous developments of the electric coolant pump in accordance with the invention are the subject of the dependent claims.

In one advantageous embodiment, an inlet opening can be formed in the pump housing so that the coolant to be conveyed can flow into the pump housing Such an inlet opening permits a defined supply of coolant. The flow direction and the flow volume can be adapted appropriately by the dimensioning and position of the inlet opening. It is particularly advantageous to form the inlet opening in the housing wall facing the pump impeller. In this way, the flow movement of the coolant to be conveyed generated by the pump impeller can directly ensure a movement of the coolant within the pump housing.

In a preferred embodiment, the inlet opening is provided with a filter element for filtering the inflowing coolant. This provides protection for the components disposed within the pump housing against fouling or damage caused by impurities possibly present in the cooling circuit. For example, in this way, particles which have a detrimental effect on the operation of the rotor shaft bearing or of the rotor are prevented from being drawn in.

In a preferred embodiment, the pump housing is filled with a dielectric cooling fluid as the coolant to be conveyed. In an advantageous manner, constituents which limit metal corrosion are added to this cooling fluid. In this way, largely maintenance-free, robust and long-lasting operation of the coolant pump is ensured. At the same time, electric malfunctioning of the electric motor or of the control circuit can be prevented.

In a preferred embodiment, the coolant pump can further comprise a sliding bearing for mounting the rotor shaft in the pump housing. In addition to the cost saving compared to the also possible roller bearing or ball bearing, the necessary installation space is also reduced. The coolant pump can have a correspondingly compact construction.

In a preferred embodiment, the pump housing can be made of a polymer material. Since the heat discharge of the electric motor and of the control circuit takes place via the coolant to be conveyed, the heat discharge capability of the pump housing has a subordinate role. It is thus possible to dispense with a metal housing and to resort to an inexpensive pump housing made of a polymer material. The pump housing can thereby be produced in particular from a thermoplastic polymer material. This has the advantage that the stator can be easily insert-molded with the material of the housing. This simplifies manufacture of the coolant pump.

DESCRIPTION OF THE DRAWING

The invention will be explained in more detail hereinunder with reference to exemplified embodiments and with the aid of the accompanying Figures in which.

The structure of two exemplified embodiments of the electric coolant pump in accordance with the invention is described hereinunder with reference to the drawings.

Figure 1:
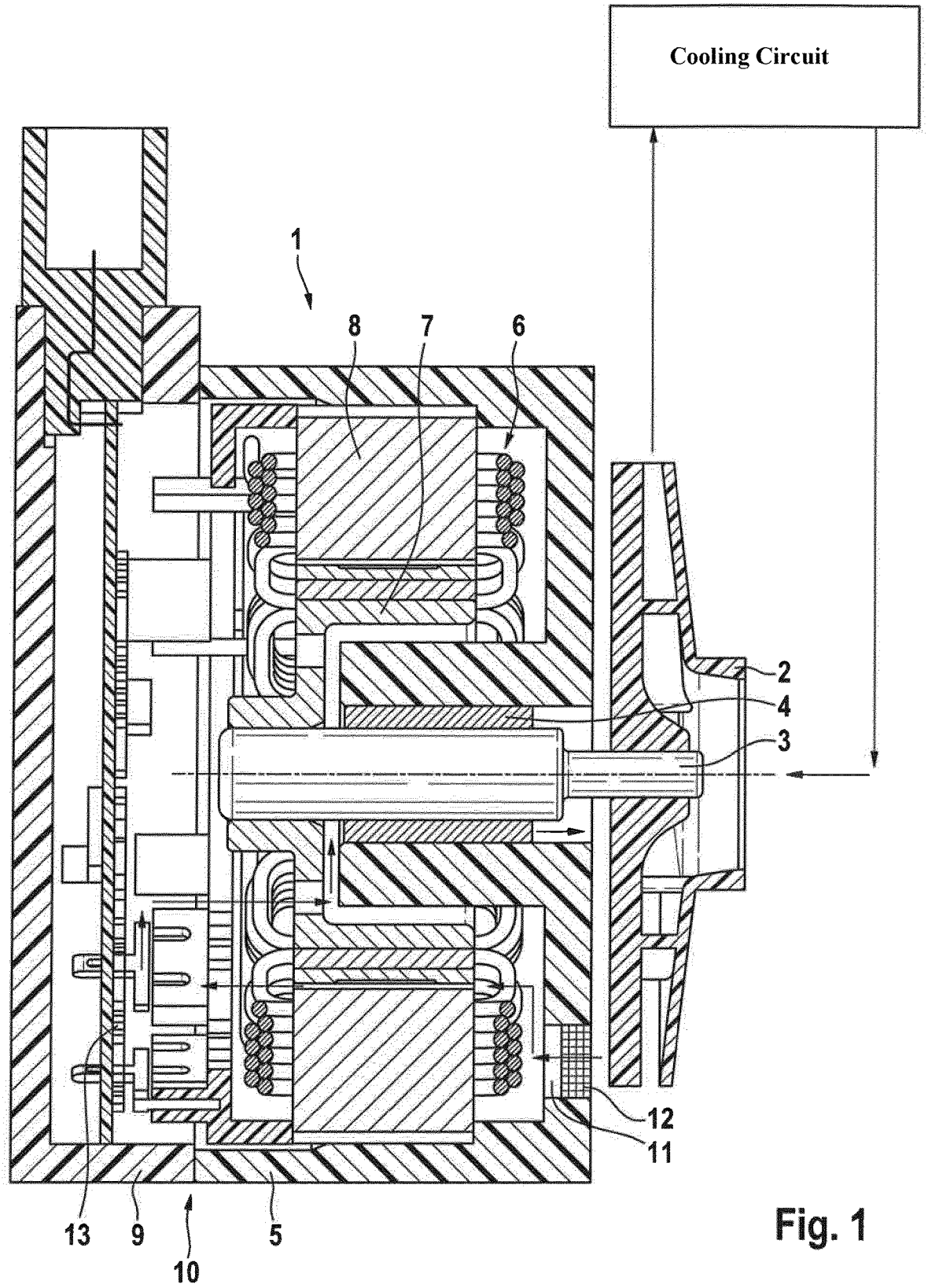
FIG. 1 is a cross-sectional view of a first exemplified embodiment of the electric coolant pump.

The electric coolant pump 1 illustrated in FIG. 1 serves to convey a coolant in a cooling circuit illustrated schematically. This cooling circuit can serve e.g. to cool a combustion engine of a motor vehicle and can consist essentially of cooling ducts through which the coolant is supplied to the components to be cooled and then to a heat sink (e.g. cooler). These coolant ducts are not shown in more detail in the Figures of the drawings. The coolant can be e.g. a dielectric cooling fluid to which constituents which limit metal corrosion are added. This coolant is circulated within the cooling circuit by a pump impeller 2 of the coolant pump 1. The movement direction of the coolant within the cooling circuit is indicated by arrows in the Figures of the drawings.

The pump impeller 2 is fixed on a rotor shaft 3. This rotor shaft 3 is in turn mounted in a pump housing main body 5 by a slide bearing 4. A cylindrical inner wall which serves as a support for the slide bearing 4 is formed in the pump housing main body 5 in order to support the slide bearing 4. An electric motor 6 drives the rotor shaft 3 and therefore the pump impeller 2. For this purpose, a rotor 7 of the electric motor 6 is flange-mounted onto the rotor shaft 3. More precisely, the rotor 7 is a pot-shaped or bell-shaped rotor 7 which is connected to the rotor shaft 3 by a first end region, and a second end region encompasses the cylindrical inner wall radially on the outside. A stator 8 arranged for conjoint rotation with the pump housing main body 5 encloses the rotor 7 radially on the outside. The stator 8 causes the rotor 7 to rotate and in this way ensures that the pump impeller 2 is driven.

The pump housing main body 5 is substantially pot-shaped and, together with a housing cover 9, forms the pump housing 10. The end face of the pump housing main body 5 opposite the housing cover 9 is penetrated by the rotor shaft 3 and so the pump impeller 2 lies outside the pump housing 10, but in the immediate proximity and parallel to the above-mentioned end face within the cooling circuit (i.e. in particular within a coolant duct). An inlet opening 11 is formed in this end face and is provided with a filter 12 for filtering the inflowing coolant. The inlet opening 11 is disposed in such a way that it lies within the region of a projection of the pump impeller 2 perpendicularly to the end face.

Disposed in the end region of the pump housing 10 opposite the pump impeller 2, i.e. in the region of the housing cover 9, is a control circuit 13 of the electric motor 6. The control circuit 13 is designed as an ECU. The electronic components of the control circuit 13 are orientated in the direction of the inside of the pump housing 10.

The pump housing 10 is designed to be fluid-tight with respect to the atmosphere and so the coolant located within the pump housing 10 cannot escape into the environment. The pump housing main body 5 and the housing cover 9 are produced from a thermoplastic polymer material.

During circulation of the coolant in the cooling circuit by the pump impeller 2, some of the coolant is introduced into the pump housing 10 via the inlet opening 11, flows around the components fixed inside the pump housing 10 and leaves the pump housing in the region of the slide bearing 4 and the penetration of the rotor shaft 3 through the end face in the region of the pump impeller 2. The coolant flow of the coolant within the pump housing 10 is likewise shown by arrows in the Figures of the drawings. The coolant introduced flows around, in particular, the stator 8, the control circuit 13 and the rotor 7 in order then to leave the pump housing 10 in the region of the slide bearing 4. The rotor 7, the stator 8 and the electronic components of the control circuit 13 are therefore in direct contact with the coolant to be conveyed. This direct contact results in particularly effective cooling of the components.

Figure 2:
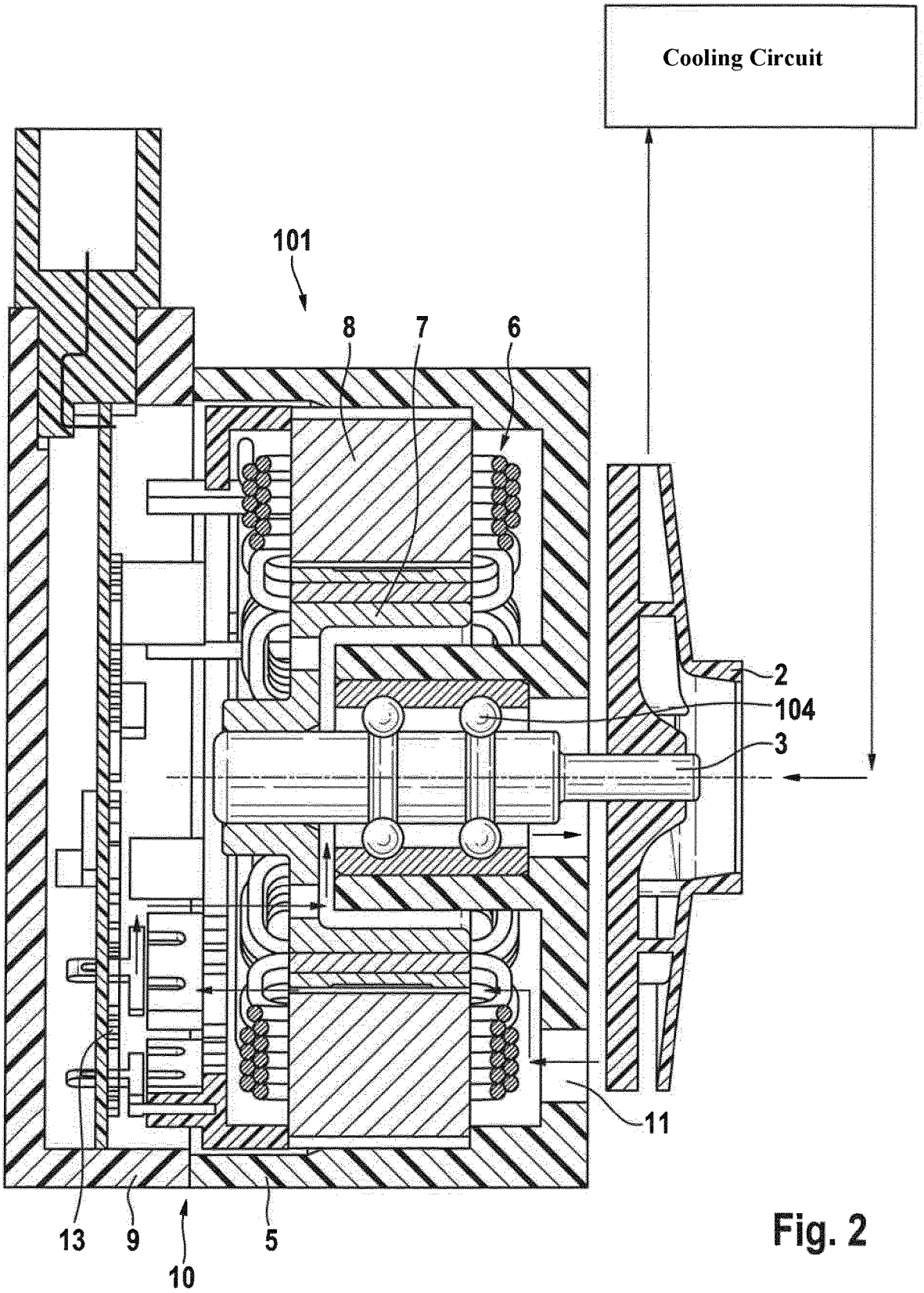
FIG. 2 is a cross-sectional view of a second exemplified embodiment of the electric coolant pump.

The electric coolant pump 101 illustrated in FIG. 2 differs from the coolant pump 1 illustrated in FIG. 1 only in the design of the rotor shaft bearing and in the absence of the filter 12 in the inlet opening 11. Instead of the slide bearing 4 of FIG. 1, the rotor shaft 3 is mounted by a roller bearing 104 in the pump housing main body 5 in this embodiment.

Figure 3:
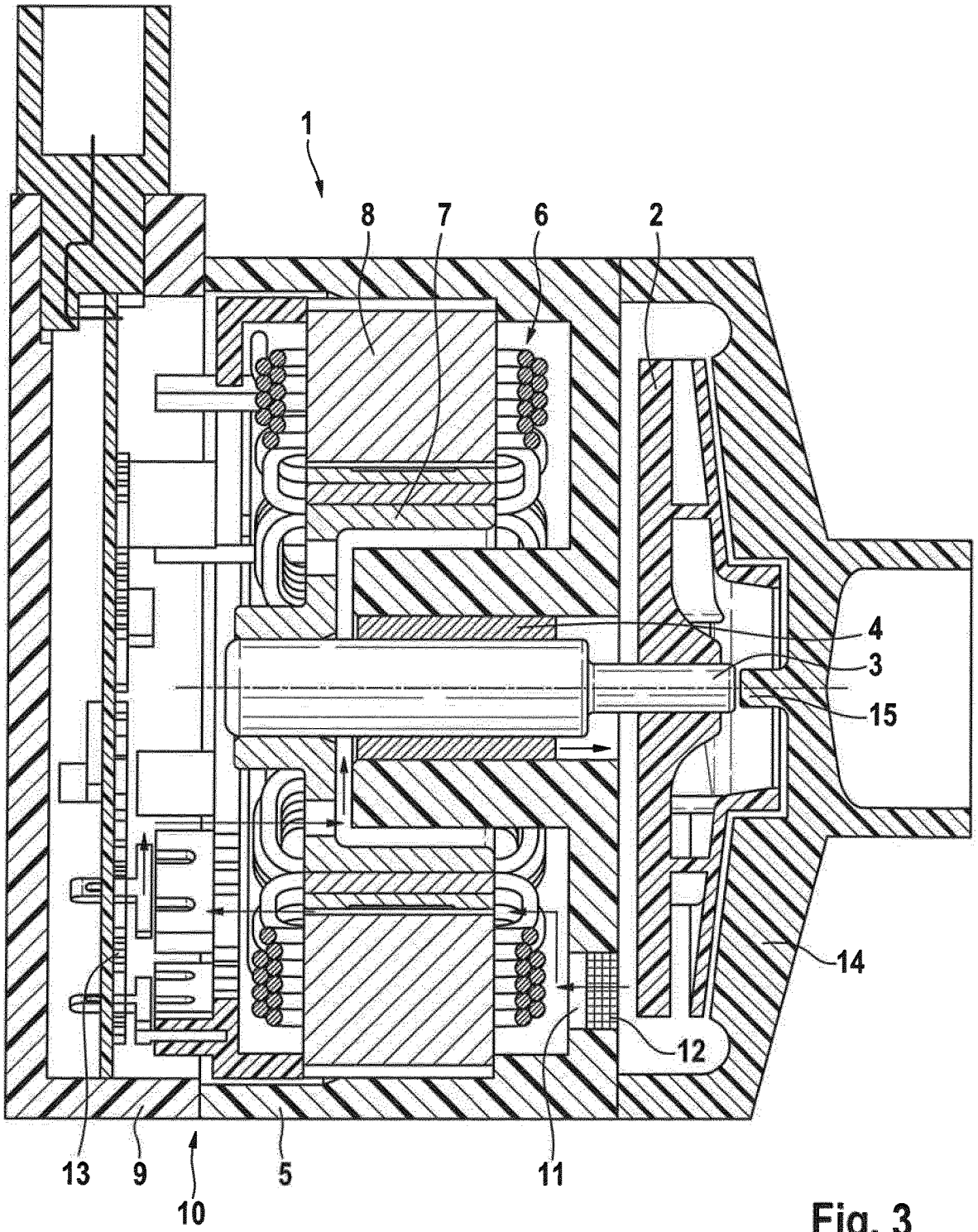
FIG. 3 is a further cross-sectional view of the first exemplified embodiment of the electric coolant pump.

FIG. 3 illustrates a further cross-sectional view of the electric coolant pump 1 illustrated in FIG. 1. Whereas FIG. 1 merely schematically illustrates the inflow of the coolant via the cooling circuit, FIG. 3 shows an impeller-side housing closure 14 designed as a cover, which, together with the pump housing main body 5 and the pump impeller 2, forms a specific structure for a flow chamber for the coolant in the region of the coolant pump 1.

Coaxially to the central axis of the rotor shaft 3, a protrusion 15 is formed on the impeller-side housing closure 14 and serves as an axial bearing for the rotor shaft 3. Together with the slide bearing 4, this protrusion 15 therefore ensures a stable bearing arrangement for the rotor shaft 3 and for the pump impeller 2 fixed to the rotor shaft 3.

In the embodiment of the coolant pump 1 illustrated in FIG. 3, the axial bearing of the rotor shaft 3 is formed in the impeller-side housing closure 14. However, it is also possible for the axial bearing of the shaft to be formed in the pump housing main body 5 or possibly even in the housing cover 9.

REFERENCE LIST

1 coolant pump
2 pump impeller
3 rotor shaft
4 slide bearing
5 pump housing main body
6 electric motor
7 rotor
8 stator
9 housing cover
10 pump housing
11 inlet opening
12 filter
13 control circuit
14 impeller-side housing closure
15 protrusion
101 coolant pump
104 coolant pump

The invention claimed is:

1. An electric coolant pump for conveying a coolant in a cooling circuit to cool a combustion engine of a motor vehicle, said pump comprising:

a pump impeller for accelerating the coolant to be conveyed;

a rotor shaft on which the pump impeller is fixed, an electric motor for driving the rotor shaft, the electric motor comprising a stator and a rotor, a control circuit for controlling the electric motor, and a pump housing accommodating at least the control circuit and the electric motor, some of the coolant to be conveyed flowing along a flow path through the pump housing, and around the stator, the rotor and the control circuit;

wherein the pump housing is filled with a dielectric coolant fluid comprising the coolant to be conveyed;

wherein the pump housing is fluid-tight relative to atmosphere;

wherein electronic components of the control circuit are in direct contact with the dielectric coolant fluid;

wherein a housing wall of the pump housing is penetrated by the rotor shaft and the pump impeller lies outside the pump housing; and wherein an inlet opening is formed in the housing wall of the pump housing facing the pump impeller so that some of the coolant to be conveyed flows into the pump housing.

2. The electric coolant pump according to claim 1, wherein the inlet opening is provided with a filter for filtering the inflowing coolant.

3. The electric coolant pump according to claim 1, further comprising a sliding bearing for mounting the rotor shaft in the pump housing.

4. The electric coolant pump according to claim 1, wherein the pump housing is made of a polymer material.

5. The electric coolant pump according to claim 4, wherein the stator is insert molded with the polymer material.

* * * * *